US010826230B1

(12) United States Patent
Goebel et al.

(10) Patent No.: US 10,826,230 B1
(45) Date of Patent: Nov. 3, 2020

(54) SPRING MOUTH CONNECTOR

(71) Applicant: HOLLAND ELECTRONICS, LLC, Ventura, CA (US)

(72) Inventors: George Goebel, Camarillo, CA (US); Brad Niems, Somis, CA (US); Michael Holland, Santa Barbara, CA (US)

(73) Assignee: HOLLAND ELECTRONICS, LLC, Ventura, CA (US)

( * ) Notice: Subject to any disclaimer, the term of this patent is extended or adjusted under 35 U.S.C. 154(b) by 0 days.

(21) Appl. No.: 16/669,977

(22) Filed: Oct. 31, 2019

(51) Int. Cl.
*H01R 13/62* (2006.01)
*H01R 43/26* (2006.01)

(52) U.S. Cl.
CPC ..... *H01R 13/62* (2013.01); *H01R 43/26* (2013.01)

(58) Field of Classification Search
USPC ..... 439/252, 877–892
See application file for complete search history.

(56) References Cited

U.S. PATENT DOCUMENTS 4,846,714 A * 7/1989 Welsby ..... H01R 13/62 439/348
4,941,846 A * 7/1990 Guimond ..... H01R 24/542 439/180
5,435,745 A * 7/1995 Booth ..... H01R 9/0521 439/583
5,598,132 A * 1/1997 Stabile ..... H01R 24/46 333/22 R
6,716,062 B1 * 4/2004 Palinkas ..... H01R 9/0521 439/320
7,753,705 B2 * 7/2010 Montena ..... H01R 9/05 439/277
8,152,551 B2 * 4/2012 Zraik ..... H01R 24/40 439/322
8,221,161 B2 * 7/2012 Leibfried, Jr. ..... H01R 13/6277 439/253
8,419,469 B2 * 4/2013 Montena ..... H01R 9/0524 439/578
8,777,661 B2 * 7/2014 Holland ..... H01R 24/38 439/108
9,147,955 B2 * 9/2015 Hanson ..... H01R 13/2421
10,069,257 B1 * 9/2018 Soubh ..... H01R 9/0527
10,658,794 B2 * 5/2020 Zhang ..... H01R 13/645
10,700,475 B2 * 6/2020 Hanson ..... H01R 13/6583
2002/0013088 A1 * 1/2002 Rodrigues ..... H01R 24/38 439/578
2012/0129387 A1 * 5/2012 Holland ..... H01R 43/14 439/578
2012/0252263 A1 * 10/2012 Ehret ..... H01R 9/05 439/578
2015/0038009 A1 * 2/2015 Gibson ..... H01R 24/525 439/578

* cited by examiner

*Primary Examiner* — Harshad C Patel
(74) *Attorney, Agent, or Firm* — Paul P. Chancellor; Ocean Law

(57) ABSTRACT

A coaxial cable connector has a tubular post that passes through an annular end of an unthreaded inner shell for grasping a mating connector and through an annular end of a body, the body and the inner shell irrotatably coupled to the post neck.

18 Claims, 13 Drawing Sheets

SPRING MOUTH CONNECTOR

BACKGROUND OF THE INVENTION

Field of the Invention

The present invention relates to an article of manufacture for conducting electrical signals. In particular, a male F-Type coaxial cable connector includes concentric moving parts that engage the connector with a mating port.

Discussion of the Related Art

F-Type connectors are widely used for making coaxial connections. Well known connectors include those with rotatable fasteners for engaging externally threaded ports.

For example, FIG. 1 shows a prior art F-Type Connector 100. Parts of the connector include a fastener 30, a post 40, a body 60, and an end cap 70. Design features of this connector include a rotatable fastener 30 with threads 32 for engaging an externally threaded port and a post flange 44 adjacent to the fastener threads. The annular cavity 80 between the post and the body is for receiving a coaxial cable.

In particular, the prior art connector post 40 has a flanged end 44 that is rotatable about the post against an internal fastener rim 34. A fastener trailing overhang 90 surrounds a body nose 62 such that a seal or O-Ring therebetween provides a connector fastener to body seal.

F-Type connectors that avoid rotatable fasteners are rare.

F-Type connectors that utilize a linearly actuated engagement means are also rare.

SUMMARY OF THE INVENTION

The present invention provides a coaxial cable connector with concentric parts that move linearly with respect to each other to engage or disengage a threaded port. Various embodiments include one or more of the features described below.

In an embodiment, a spring mouth F-Type connector comprises: a tubular post having a stem extending from a flanged end, the stem having a thickened neck adjacent to the flange; the post passes through an annular end of an unthreaded inner shell and through an annular end of a body, the body abutting the inner shell and the inner shell abutting the flange; the body and the inner shell irrotatably coupled to the post neck; the inner shell having an annular socket at one end, the socket for receiving the flange in a counterbored section of the socket such that an annular floor of the socket includes a flange face and a socket face that lie substantially in the same plane; a spring coiled about the post neck, the spring having ends that push on an outer sleeve and on a body shoulder; the outer sleeve moveable with respect to the inner sleeve such that in a first position finger tips of fingers of the inner sleeve are constrained by the outer sleeve and in a second position the finger tips are free to move away from a connector centerline; movement of the outer shell to the second position compresses the spring while uncovering the inner shell such that a port is insertable in a finger basket of the inner shell; movement of the outer shell to the first position expands the spring while covering the inner shell such that the port is fixed in the finger basket of the inner shell; and, port fixation accomplished by finger tip grooves that engage threads of the inserted port.

In an embodiment A spring mouth F-Type connector comprises: an inner shell between first and second ends, the ends having a radial thickness greater than the radial thickness of a central portion adjoining the ends; the first end for receiving a port and the second end for receiving a flange of a post; the inner shell having longitudinal slots such that the inner shell first end forms a cylindrical basket of fingers; each of the fingers terminating in a claw having an inwardly directed groove for mating with a port thread; the inner shell second end having first and second internal diameters adjoining a third internal diameter of the central portion; the first diameter less than the second diameter less than the third diameter; the post flange fitted in the second diameter, bearing against the first diameter such that a post neck adjacent to the flange is irrotatably fitted into the first diameter, and extending to but not into the third diameter; a post flange face and a wall adjoining the second and third diameters forming a planar floor within the second end of the inner shell, the planar floor for abutting the end of an inserted port; and, a spring coiled about the post neck that bears on a body shoulder and on the an outer shell such that the outer shell is movable with respect to the inner shell to cover or uncover the claws; wherein a port may be inserted in the finger basket when the claws are uncovered and a port may be fixed in the finger basket when the claws are covered.

BRIEF DESCRIPTION OF THE DRAWINGS

The present invention is described with reference to the accompanying figures. These figures, incorporated herein and forming part of the specification, illustrate the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of embodiments they disclose. For example, other embodiments of the disclosed device and/or method may or may not include features described herein. Moreover, disclosed advantages and benefits may apply to only certain embodiments of the invention and should not be used to limit the disclosed invention.

Figure 1:
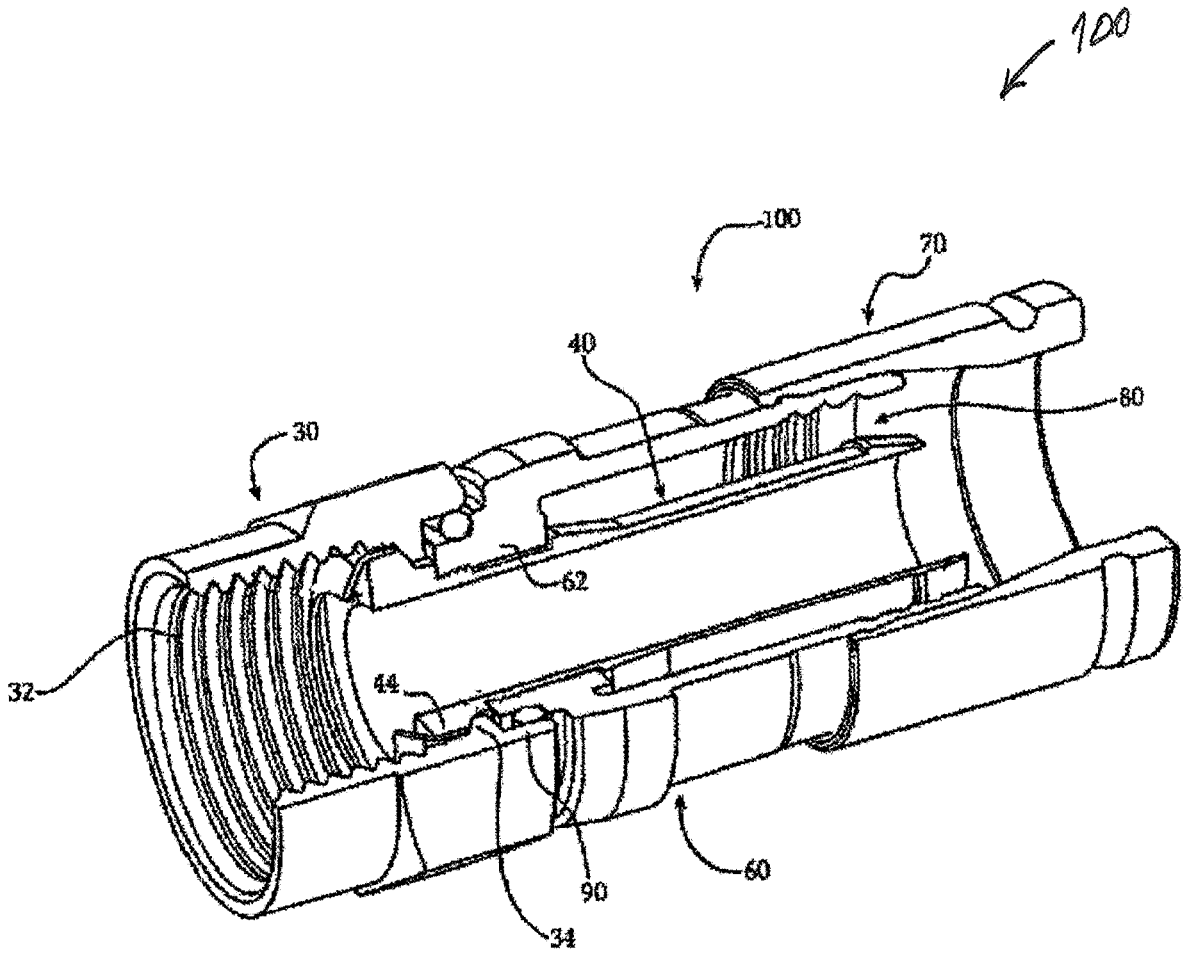
FIG. 1 (Prior Art)
FIG. 1 shows a prior art male F-Type connector.
Figure 2A:
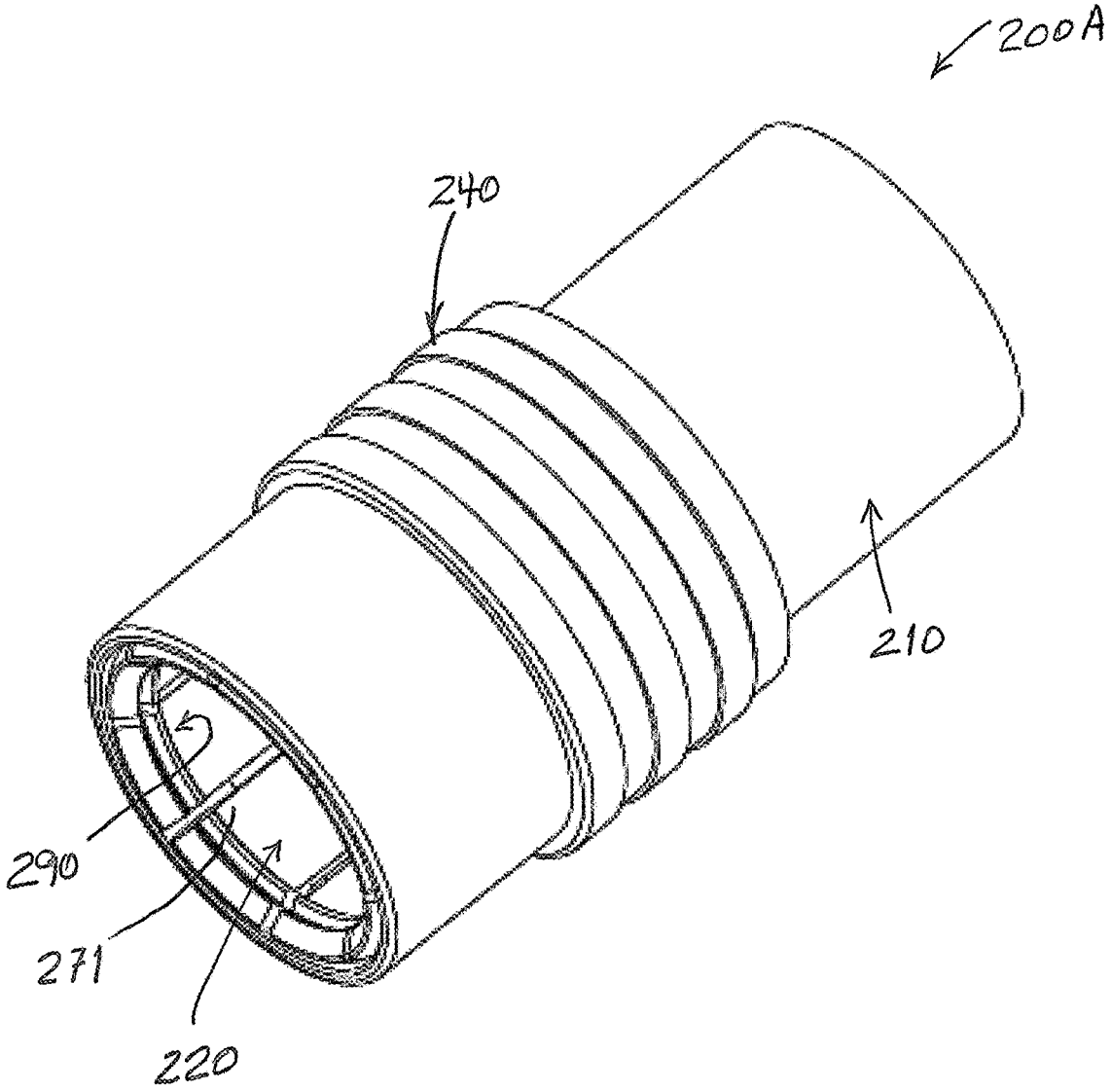
FIG. 2A shows a perspective view of a spring mouth connector.

FIG. 2A shows an embodiment of the F-Type connector of the present invention 200A. As shown, the connector includes a body 210 and an outer shell 240 for moving a basket 290 of spring fingers 271 extending from an inner shell 220. Notably, the inner shell has no internal threads.

In various embodiments, the basket 290 may include three or more fingers 271. In various embodiments, the basket may include three to ten fingers. In a particular embodiment, the basket includes eight fingers.

Figure 2B:
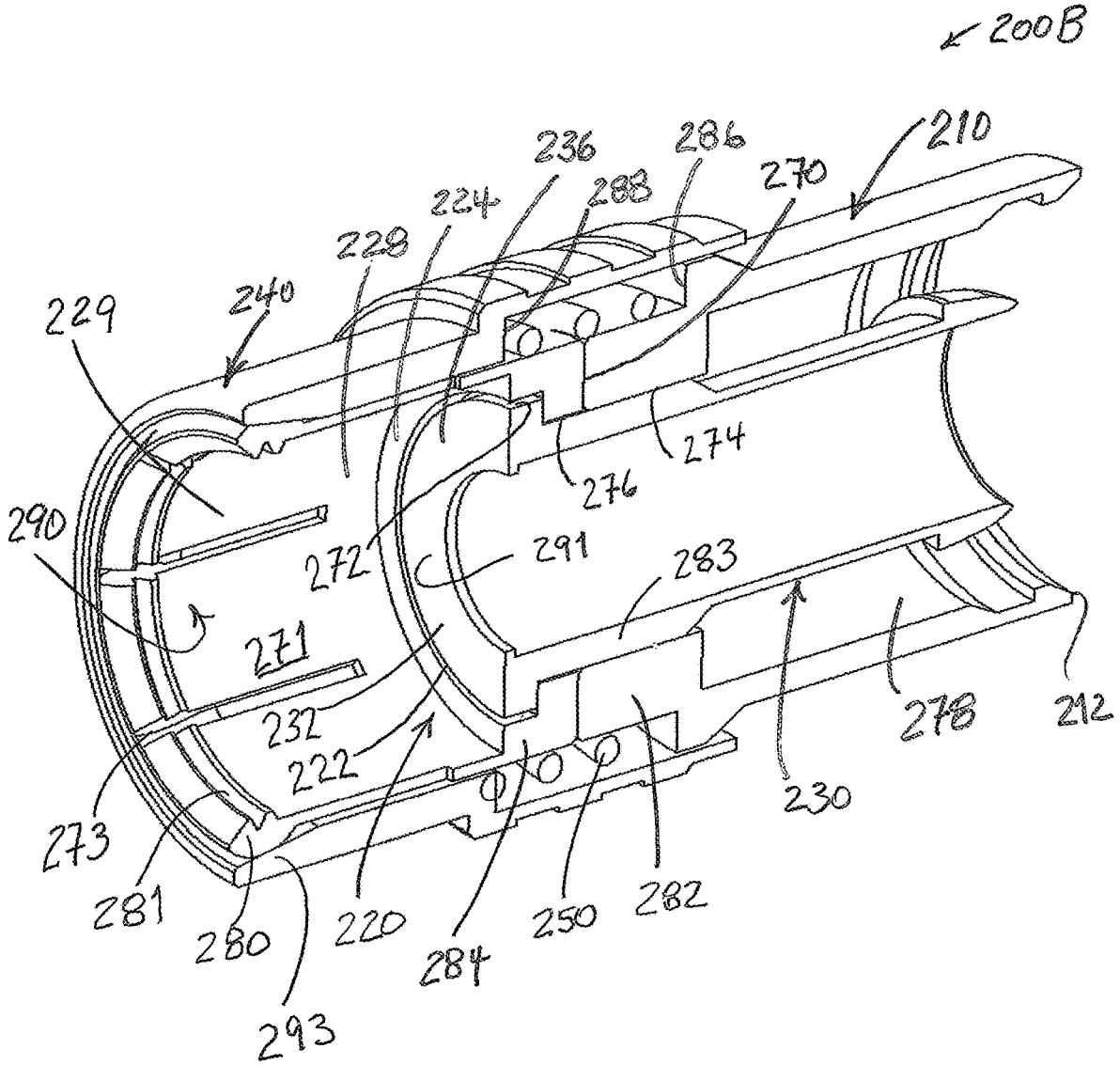
FIGS. 2B-C show perspective cross-sectional views of the connector of FIG. 2A.

FIG. 2B shows a cutaway 200B of the connector of FIG. 2A. As shown, a body 210 and an inner shell 220 are carried by a centrally located post 230. The body and the inner shell may be adjacent or abut at a joint 270 through which the post passes. A body neck 282 and an inner shell neck 284 may, for example, be adjacent or may abut at a joint 270 and may have respective interference fits 274, 276 with a neck of the post 283.

In some embodiments, a post flange 232 fits within a counterbore 222 of the inner shell 220. And, in some embodiments a flange face 236 and counterbore face 224 lie in the same plane or substantially in the same plane. Use of substantially refers to design and/or manufacturing tolerances typical of F-Type connector design and manufacture.

In some embodiments the inner shell 220 may have an annular socket 272 at one end, the socket for receiving the flange in a counterbored section 222 of the socket such that an annular floor 291 of the socket includes a flange face and a socket face that lie substantially in the same plane.

An outer shell 240 surrounds the inner shell 220 and is movable with respect to the inner shell. A spring 250 biases the outer shell such that the outer shell tends to cover the inner shell. In various embodiments the spring tends to move the outer shell away from the body as with a spring 250 that bears on opposed surfaces. For example, a spring such as a coil spring 250 may located between the outer shell and the body. In an embodiment, a body shoulder 286 and an outer sleeve shoulder 288 support opposite ends of a coil spring.

Figure 2C:
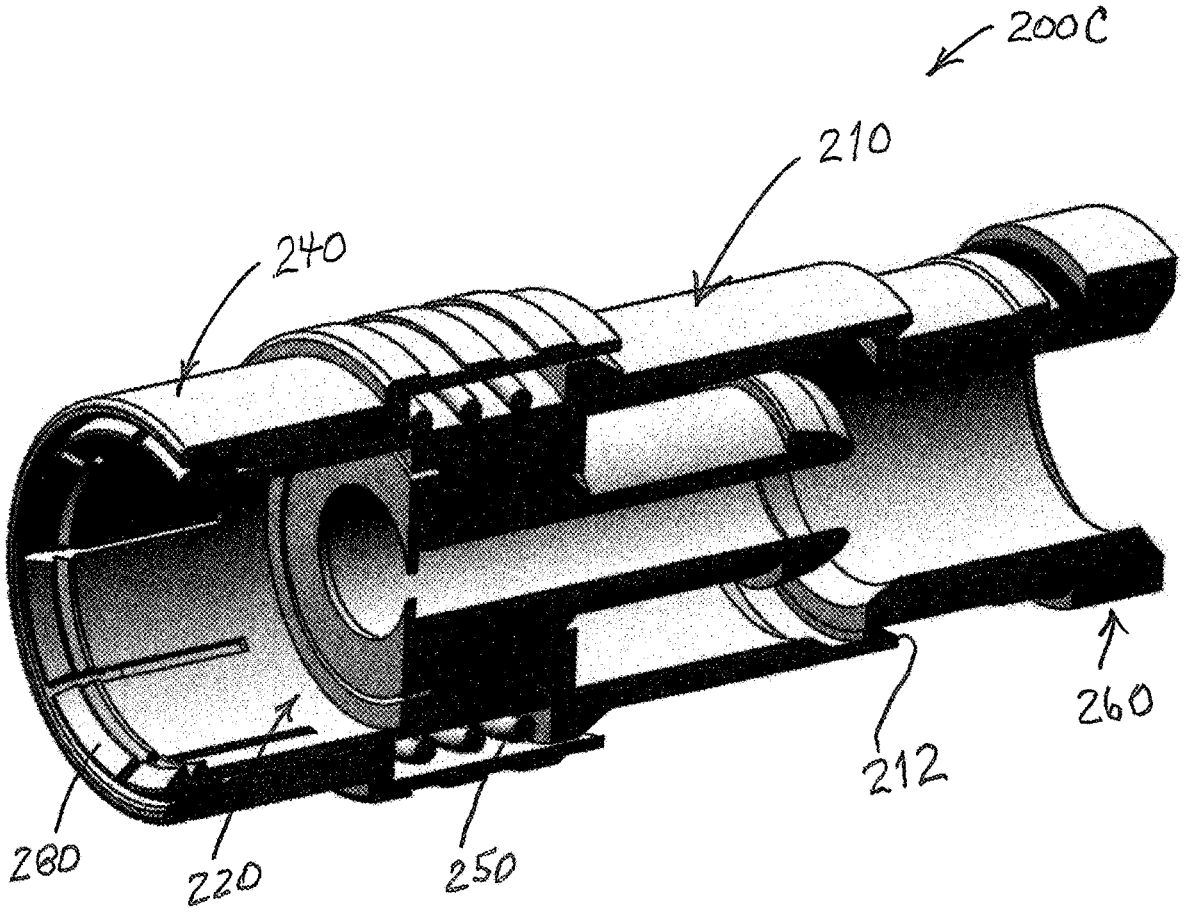

FIG. 2C shows another cutaway 200C of the connector of FIG. 2A. As shown, a connector 200C opening at a body trailing end 212 is for receiving a coaxial cable (See e.g. FIG. 5A). Methods of fixing a coaxial cable in the connector 200C include use of a cap or plug engaged with the trailing body end. For example, a plug 260 insertable in the trailing end of the connector may press a jacket and braid (see e.g. 502, 526 of FIG. 5A) of an inserted coaxial cable against the post 230 thereby fixing the coaxial cable within the connector.

Figure 3A:
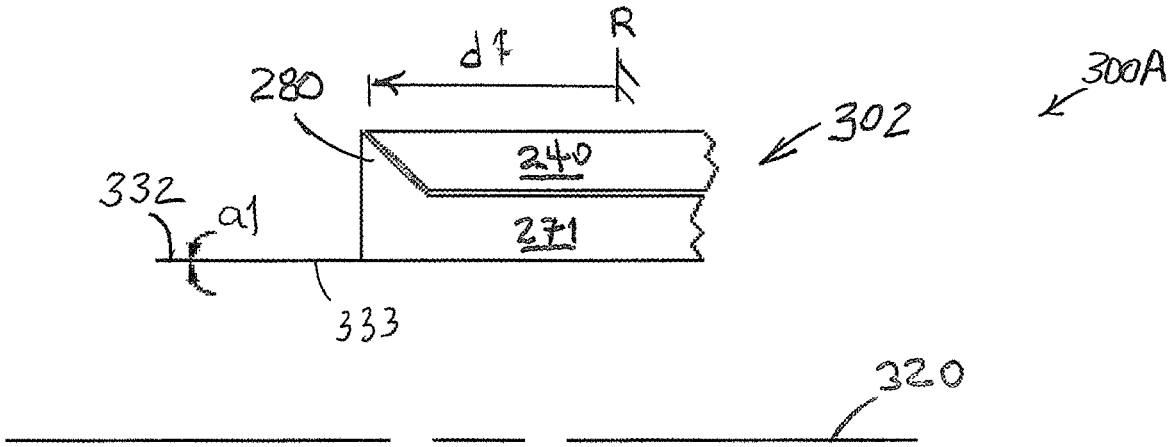
FIGS. 3A-C show operation of the inner and outer shells in an embodiment of the spring mouth connector of FIG. 2A.
Figure 3B:
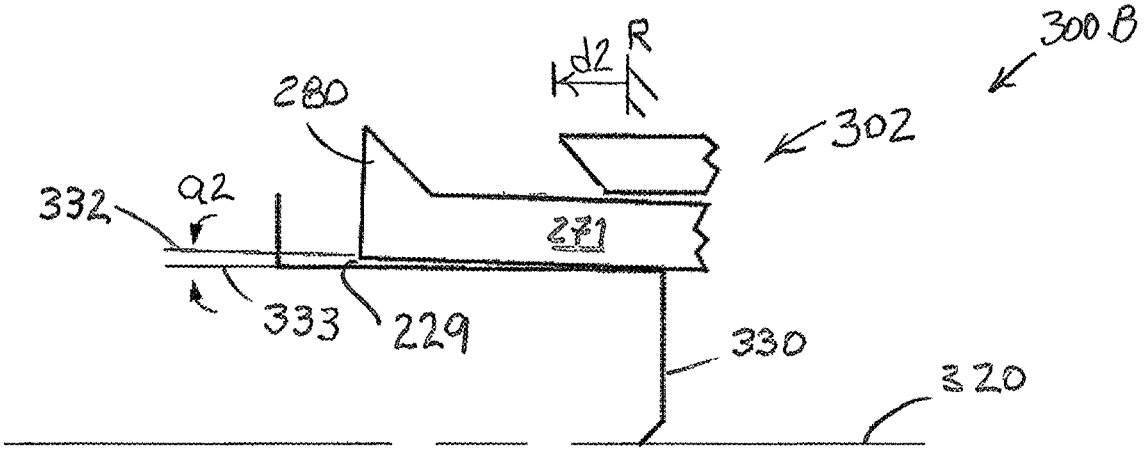

We refer now to FIGS. 2A-B and to FIGS. 3A-B showing an embodiment of finger basket operation 300A-C. As seen, the inner shell 220 includes a basket 290 of spring fingers 271. The inner shell includes a neck 284 surrounding the post 230 and a hood 228 extending from the inner shell. The free end of the hood includes a basket or circular arrangement 290 of fingers 271. The fingers are formed by slots 273 in the hood and may terminate in a thickened portion 280 that includes an inwardly directed groove 281. The groove may engage the threads of a mated F-Type port.

In various embodiments, the inner shell 271 finger tips 281 may have an arc shaped cross-section and the inner shell mouth 293 may have a ramped cross section such that the ramp engages (disengages) the arc to constrain (allow) finger or finger tip movement away from the connector centerline 320.

It is noted that the outer shell 240 prevents spreading of the fingers and/or depresses the fingers 271. Any arrangement of the outer shell and fingers may accomplish this function. For example, either of the outer shell or fingers may have thickened or thinned or ramped portions where the one presses against the other. And in some embodiments both the shell and the fingers may have thickened or thinned or ramped portions that coact or interengage to cause inward movement of the fingers.

For example, in some embodiments, when the connector 200B is pushed onto a port, the outer shell 240 is pushed forward which expands the spring 250 and results in the finger basket 290 opening up. When the connector is pushed fully onto the port, the outer shell is released and the spring expands such that the outer shell moves to bias the fingers 271 against the mating port threads. Removal of the connector from the mating port occurs when the outer shell is pulled back to compress the spring and allow the finger basket to open up which releases the mating port threads.

Figure 2D:
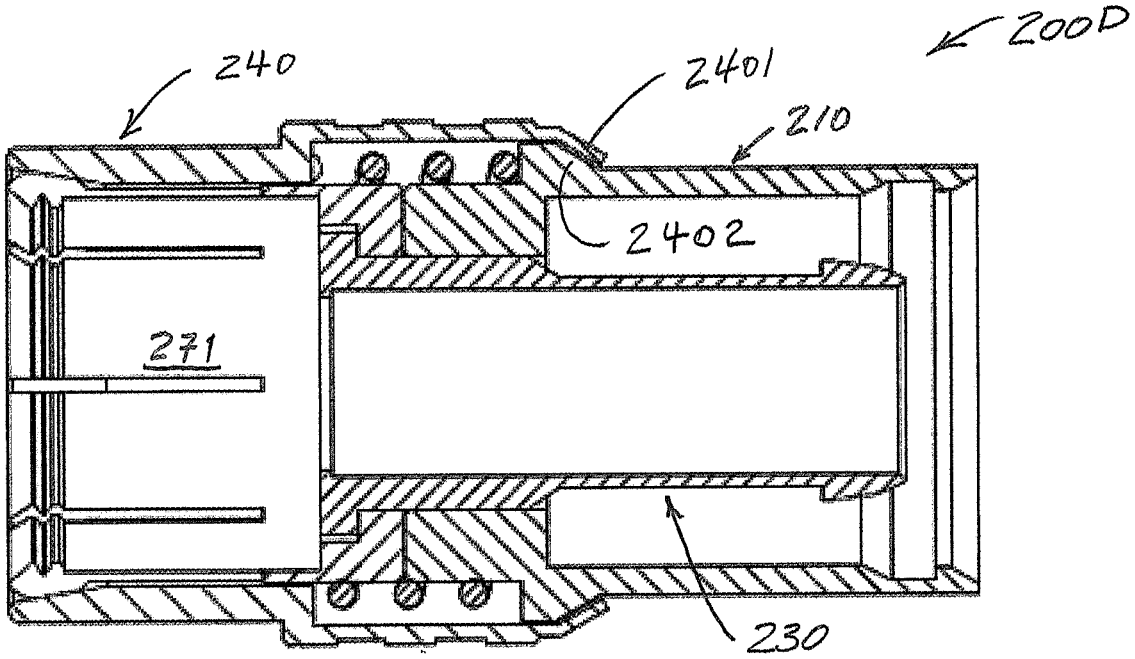
FIGS. 2D-E show cross-sectional views of the connector of FIG. 2A.
Figure 2E:
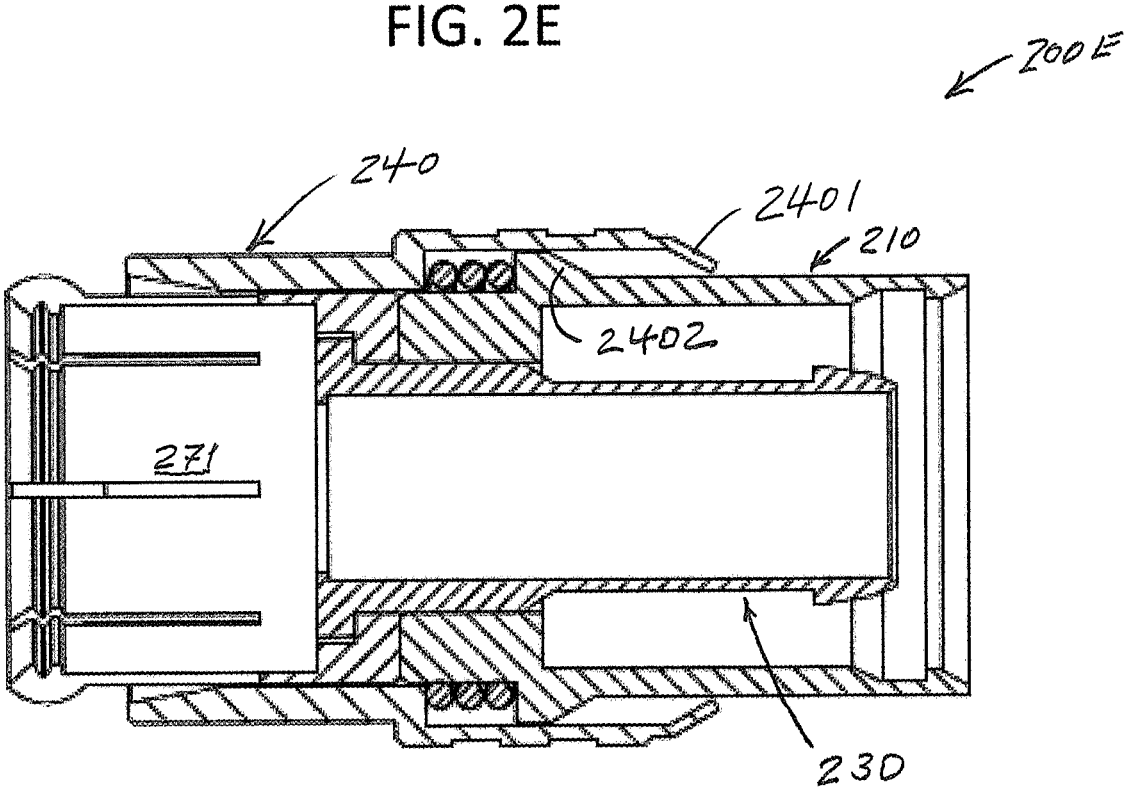

FIG. 2D and FIG. 2E show embodiments of the connector with means for stopping movement the outer shell 240 relative to the body 210. As shown in FIG. 2D, a trailing portion of the outer shell 2401 is turned inward such that when it contacts a body shoulder 2402 outer shell movement to the left it is stopped. As shown in FIG. 2E this turned in portion of the outer shell 2401 is free to move to the right and away from contact with the body shoulder 2402.

Connector 200A materials may include metals and/or polymers according to their suitability. For example, materials of construction may include metals for the body 210, outer shell 240, inner shell 220, post 230, and spring 250. For example, materials of construction may include polymers for the body. For example, materials of construction may include polymers for the outer shell. For example materials of construction may include polymers for the inner shell.

In various embodiments, the spring fingers grasp an inserted port when the outer shell 240 covers or nearly covers the inner shell 220 and its fingers 271.

Figure 3C:
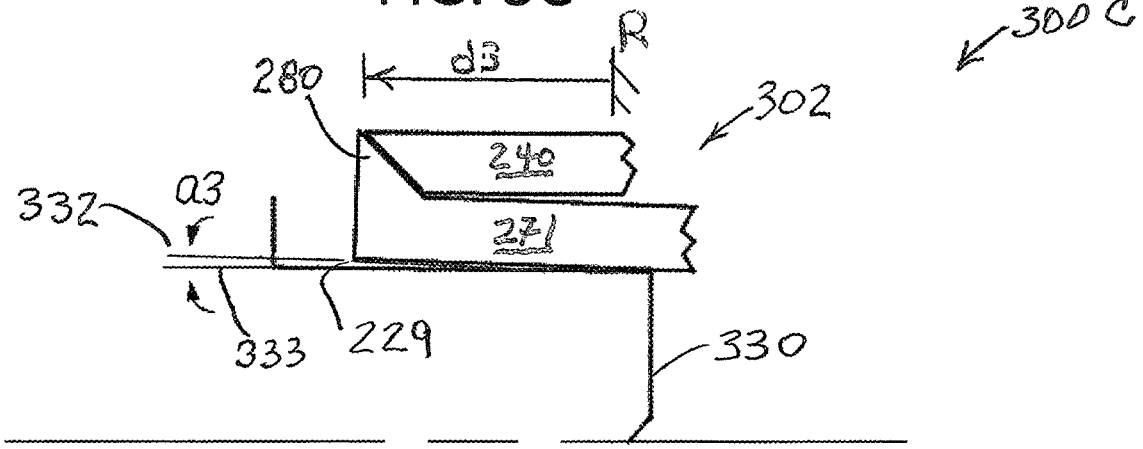

FIGS. 3A-C show an embodiment where this grasping action takes place 300A-C. In FIG. 3A, the connector 302 outer shell 240 is moved near the finger tips 280 of the fingers 271. There is no mating port inserted within the basket of fingers 290 (only one shown) and the outer shell is shown advanced a distance of d1 from the reference line R such that it substantially covers the fingers. In some embodiments an angle a1 between the inner shell inside diameter 332 and an intersecting line parallel to the connector centerline 333 is zero degrees or substantially zero degrees.

In FIG. 3B, the connector 302 outer shell 240 is moved away from the finger tips 280 of the fingers 271. With the outer shell retracted a distance d2 from the reference line R such that the finger is uncovered, a mating port is and or can be inserted within the basket of fingers 290. In some embodiments, during insertion of the port in the basket of fingers the finger tips are forced away from the connector centerline 320 so as to open up the mouth 229 of the connector 302. In some embodiments an angle a2 between the inner shell inside diameter and an intersecting line parallel to the connector centerline shows that the inner shell fingers have moved away from the connector centerline 333.

In FIG. 3C, the connector 302 outer shell is moved back toward the finger tips 280 of the fingers 271. While the outer shell is advanced a distance d3 from the reference liner R, the mating port 330 is within the connector and the mating port is substantially covered by the outer shell 240. In some embodiments, movement of the outer shell toward the finger tips with an inserted port biases the finger tips inward toward the connector centerline 320. In some embodiments an angle a3 between the inner shell inside diameter and an intersecting line parallel to the connector centerline shows that the inner shell fingers have been forced by the outer shell 240 to move back toward the connector centerline 333.

Figure 4A:
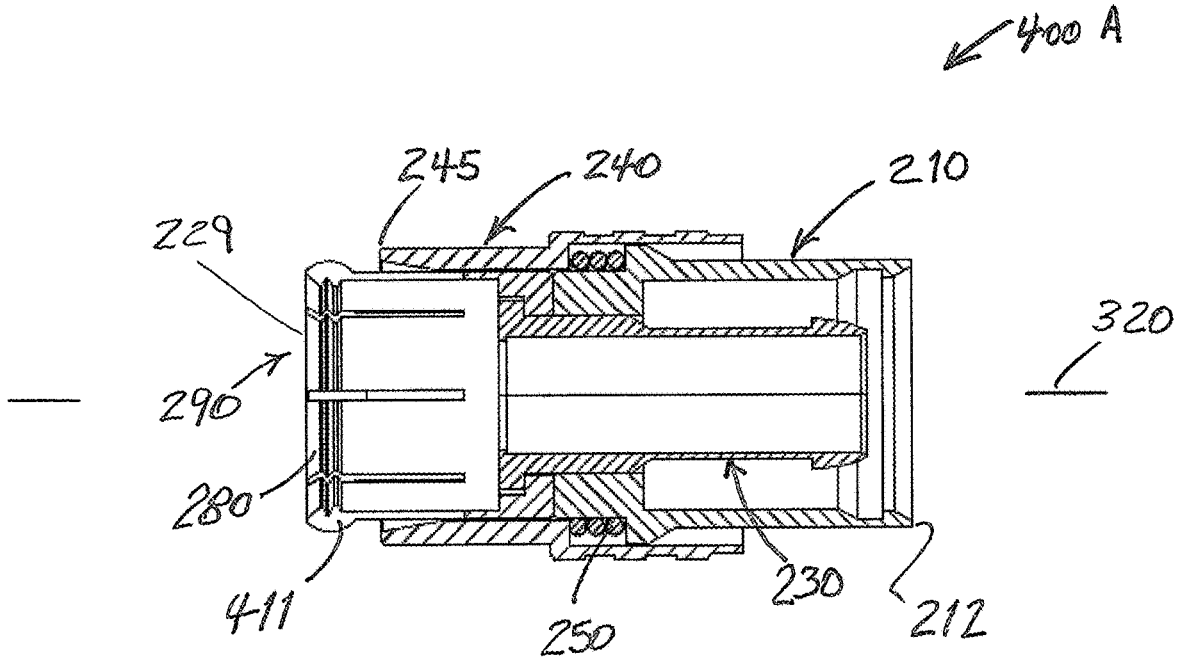
FIGS. 4A-B show cross-sectional views of linear actuation of the spring mouth connector of FIG. 2A.
Figure 4B:
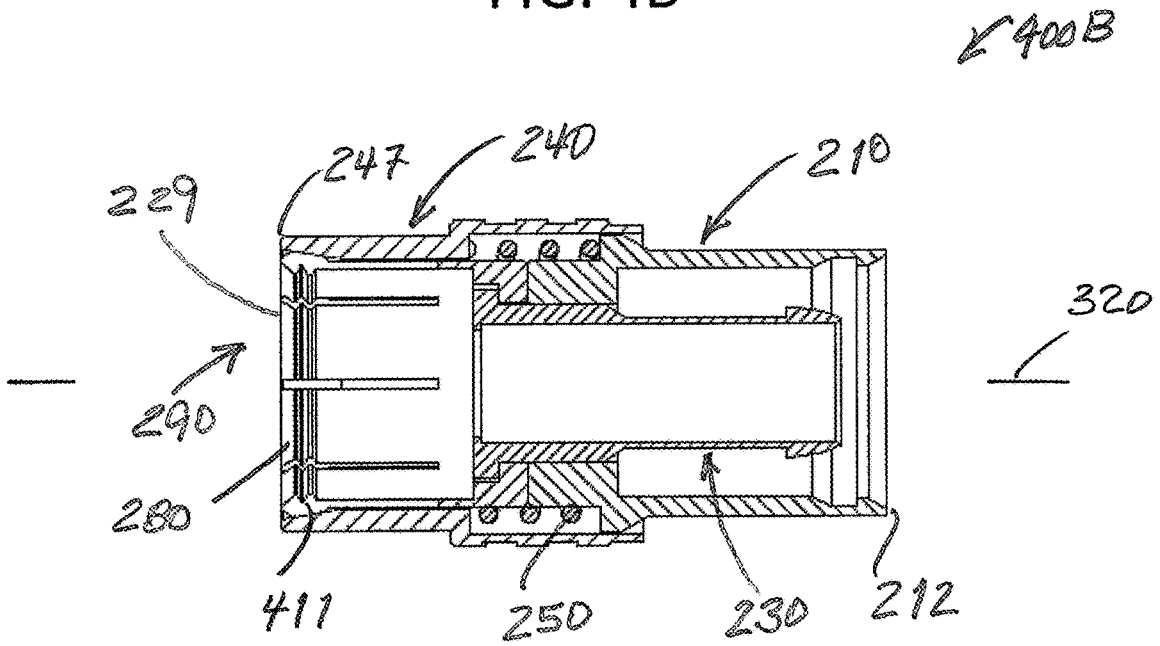

FIGS. 4A-B show cross-sectional views of the connector 400A-B. In FIG. 4A, the outer shell 240 is shown in a retracted position 245 such that the spring 250 is compressed. When the outer shell is retracted, a free end 411 of the finger basket 290 is uncovered and the finger tips 280 are free to move away from the connector centerline 320.

In FIG. 4B, the outer shell 240 is shown in an advanced position 247 such that the spring 250 is expanded. When advanced, the outer shell covers the finger basket 290 such that finger tip 280 movement away from the connector centerline 320 is constrained.

Figure 5A:
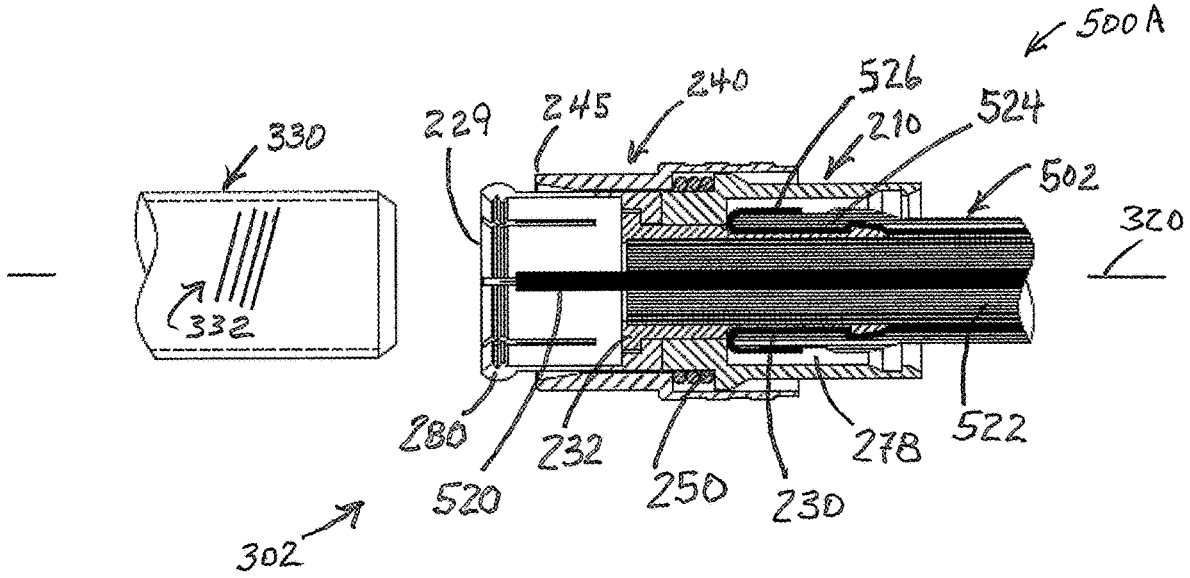
FIGS. 5A-C show cross-sectional views of the connector of FIG. 2A affixed to a coaxial cable and its configuration before, during, and after insertion and engagement of a threaded port.
Figure 5B:
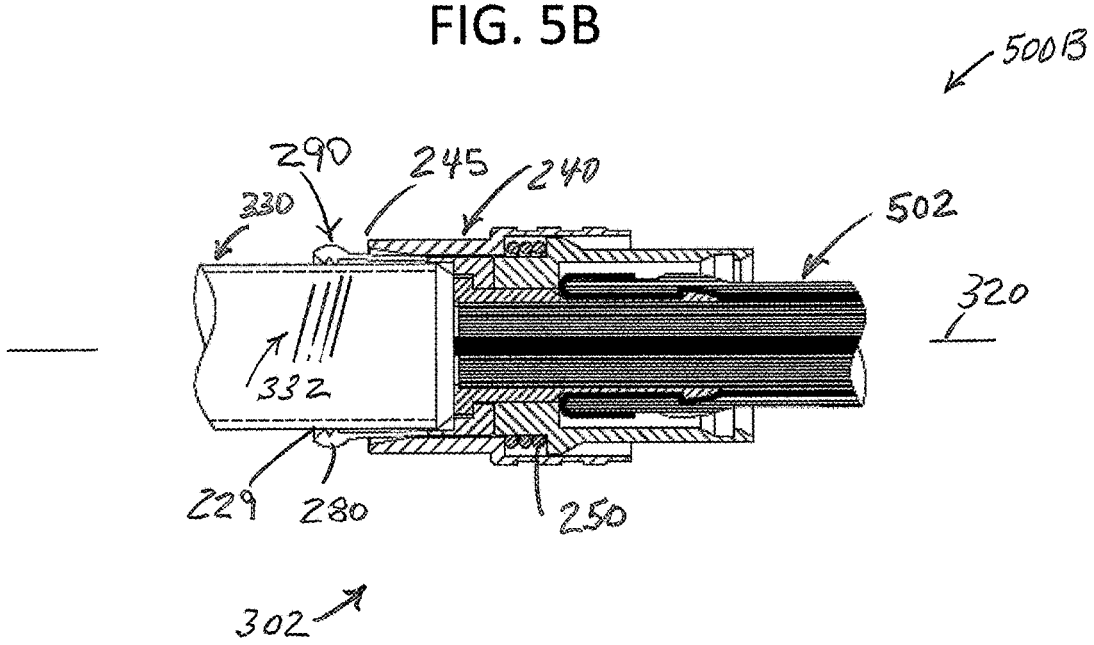
Figure 5C:
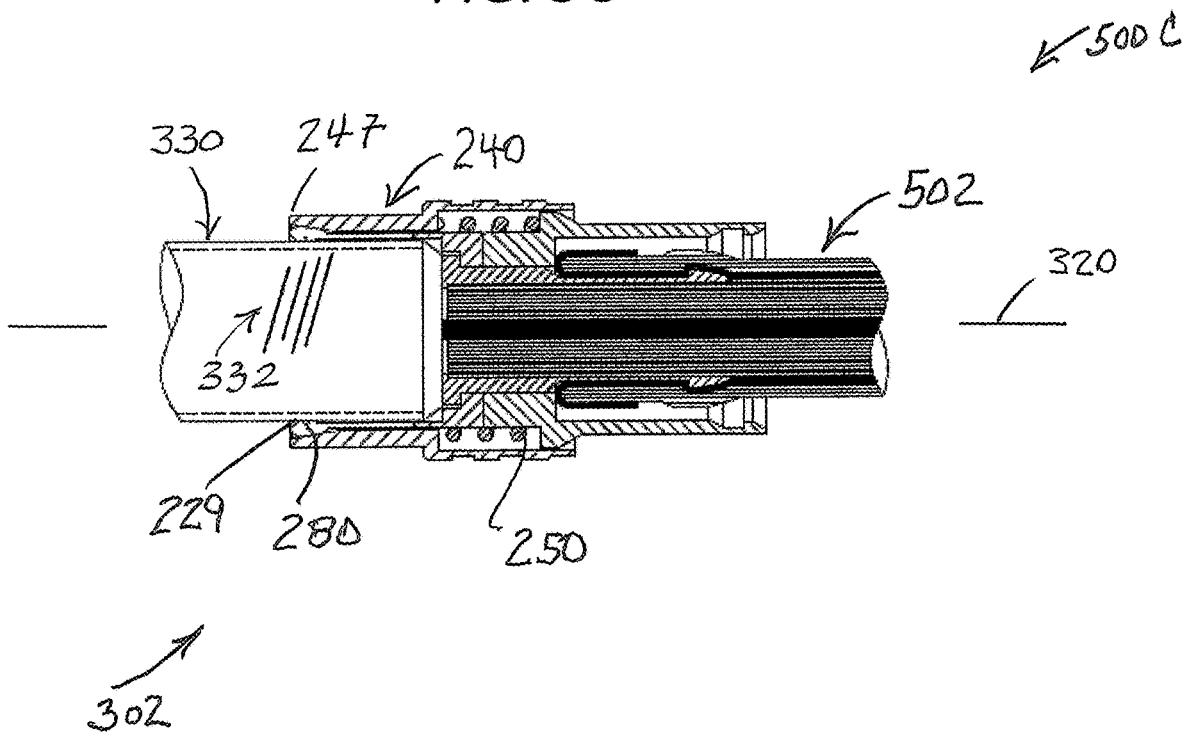

FIGS. 5A-C shows a cross-sectional view of the connector and a port 500A-C. FIG. 5A shows a coaxial cable 502 is inserted in a connector 302 with an retracted outer shell 240. The coaxial cable 502 includes a center conductor 520 that extends into the finger basket 290. A coaxial cable shield conductor 526 such as a braid and/or foil encircles a dielectric or insulating layer 522 which encircles the center conductor. The outermost layer of the coaxial cable is an insulating jacket such as a polymer jacket.

As seen, the dielectric 522 may extend only to the post flange 232 and both the shield 526 and the jacket may be terminated in the annular space 278 between the body 210 and the post 230. The shield may be turned back over the jacket where desired to aid electrical continuity and/or coaxial cable fixation.

To the left of the connector 302 is a port 330. The outer shell 240 is retracted 245 which compresses the spring 250. Because the outer shell no longer covers the finger basket, the finger tips 280 of the fingers 271 are free to move away from the connector centerline 320 such that a port can be inserted in the connector. In various embodiments, the finger tips may move away from the connector centerline when the outer shell is retracted or the finger tips may move away from the connector centerline when a port is inserted in an uncovered finger basket.

FIG. 5B shows the port 330 inserted in the mouth 229 of the connector 302 with an open finger basket 290. Because the outer shell 240 is retracted 245, the spring 250 is compressed and the finger basket 290 is open. In this configuration the finger tips 280 are located away from the connector centerline 320. In various embodiments, the grooves 281 in the finger tips (See FIG. 2B) do not engage/constrain external threads 332 of the port when the outer shell is retracted.

FIG. 5C shows the port 330 inserted in the mouth 229 of the connector 302 with a closed finger basket 290. Because the outer shell 240 is advanced 247, the spring 250 is expanded and the finger basket 290 is closed. In this configuration the finger tips 280 are located closer to the connector centerline 320. In various embodiments, the grooves 281 in the finger tips (See FIG. 2B) engage/constrain the external threads 332 of the port when the outer shell is advanced.

Figure 6A:
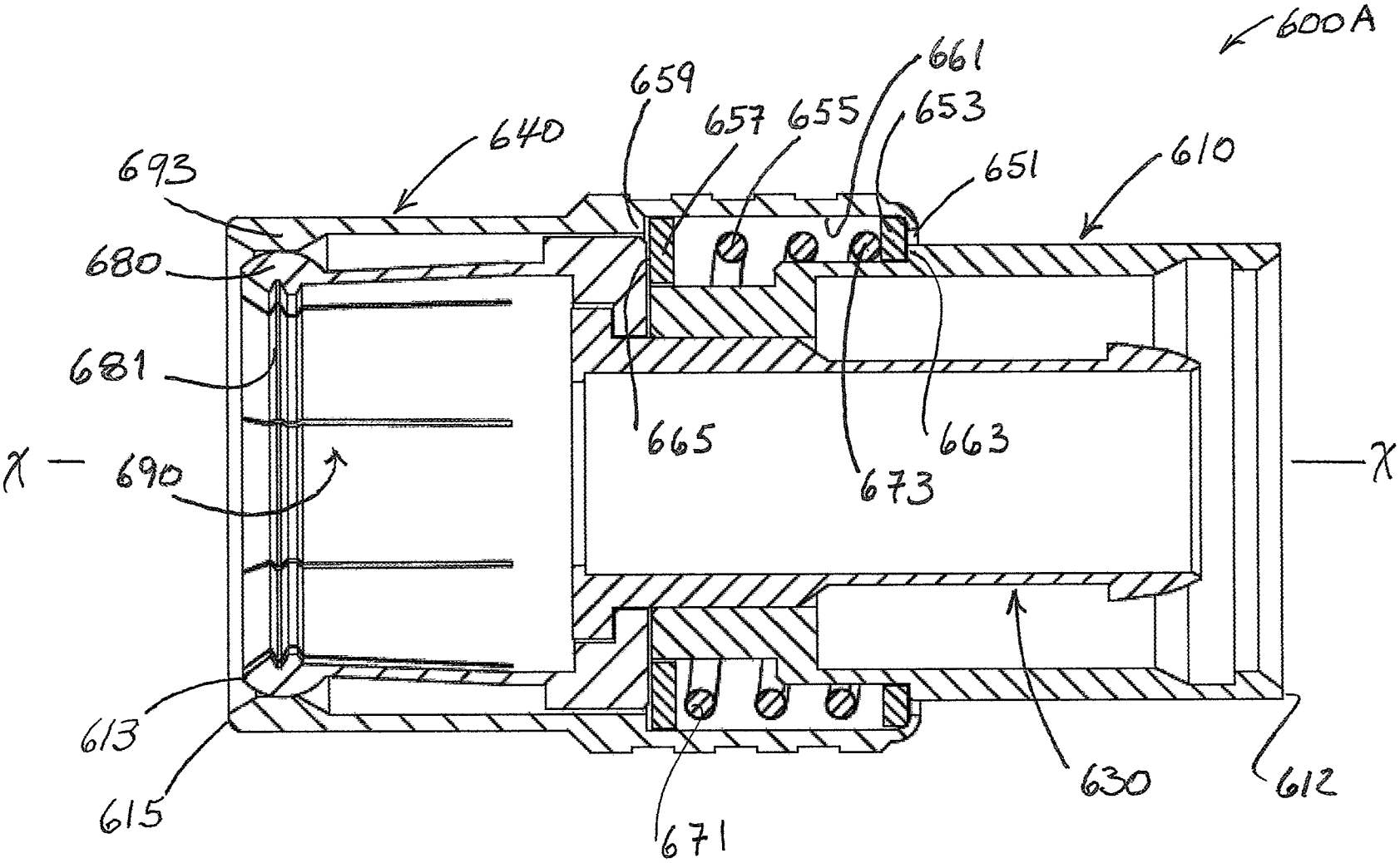
FIGS. 6A-C show cross-sectional views of a two-way outer shell.
Figure 6B:
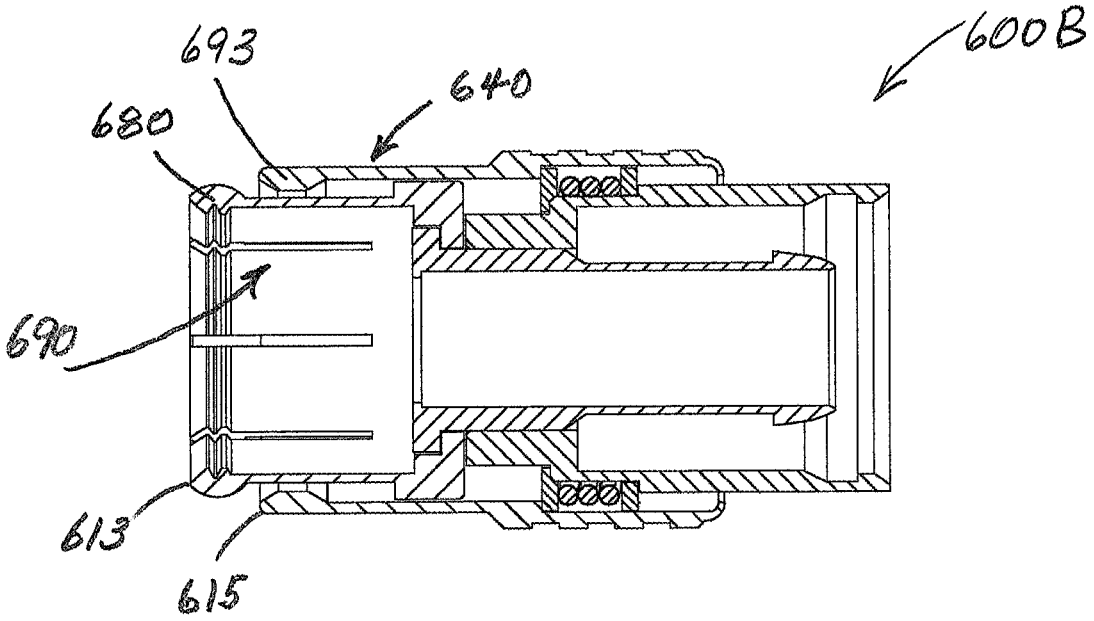
Figure 6C:
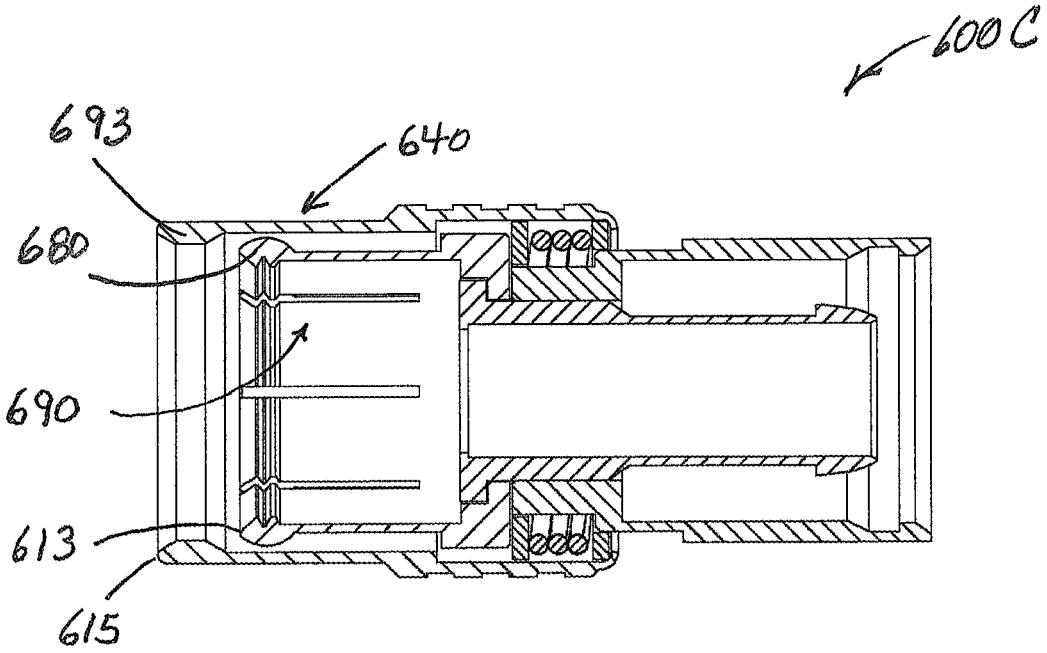

We refer now to FIGS. 6A-C showing a two-way outer shell 600A-B. As shown below, in this embodiment the connector outer shell 640 may be moved in two directions. FIG. 6B shows the outer shell moved toward the connector body trailing end 612 to uncover or partially uncover a finger basket 690. FIG. 6C shows the outer shell moved away from the trailing end such that the finger basket is within the outer shell and a tip of the outer shell 615 is advanced beyond a tip 613 of the finger basket.

FIG. 6A shows an outer shell rest position 600A. In this position, an outer shell interior pocket 661 has axially x-x spaced first and second shoulders 651, 659 with a spring 655 therebetween. The first shoulder is nearest the body trailing end 612. The second shoulder is nearest the outer shell tip 615.

In a drawn back position, the outer shell 640 is moved toward the trailing end 612 and the spring 655 is compressed. Compression occurs when a sliding member such as a first sliding body collar 657 encircling the body 610 moves away from a first rest 665 and toward the trailing end. The first collar is located between the outer shell shoulder 659 and a first spring end 671.

In a pushed forward position, the outer shell 640 is moved away from the trailing end 612 and the spring is again compressed. Compression occurs when a sliding member such as a second sliding body collar 653 encircling the body 610 moves away from a second rest 663 and away from the trailing end 612. The second collar is located between the outer shell shoulder 651 and a second spring end 673.

When the outer shell is in the rest position 600A, a thickened portion of the outer shell 693 encircles a thickened portion of the finger basket 680. As seen in the FIG. 6A, the thickened portion 693 of the outer shell 640 may bear on the thickened portion 680 of the finger basket 690 and so press the fingers toward the connector axis x-x. In other embodiments, when the outer shell is in the rest position it does not bear on the finger basket such that the fingers are pressed toward the connector axis.

When the outer shell is in the drawn back position 600B, the thickened portion of the outer shell 693 is drawn back such that the thickened portion of the finger basket 680 is uncovered. In various embodiments, the spring fingers may spring away from the connector axis (as shown) or not as a result of being uncovered.

When the outer shell is in the pushed forward position 600C, the thickened portion of the outer shell 693 is pushed over and beyond the thickened portion of the finger basket 609. In various embodiments, the spring fingers may spring away from the connector axis (as shown) or not as a result of the outer shell being pushed over and beyond the thickened portion of the finger basket.

Figure 7A:
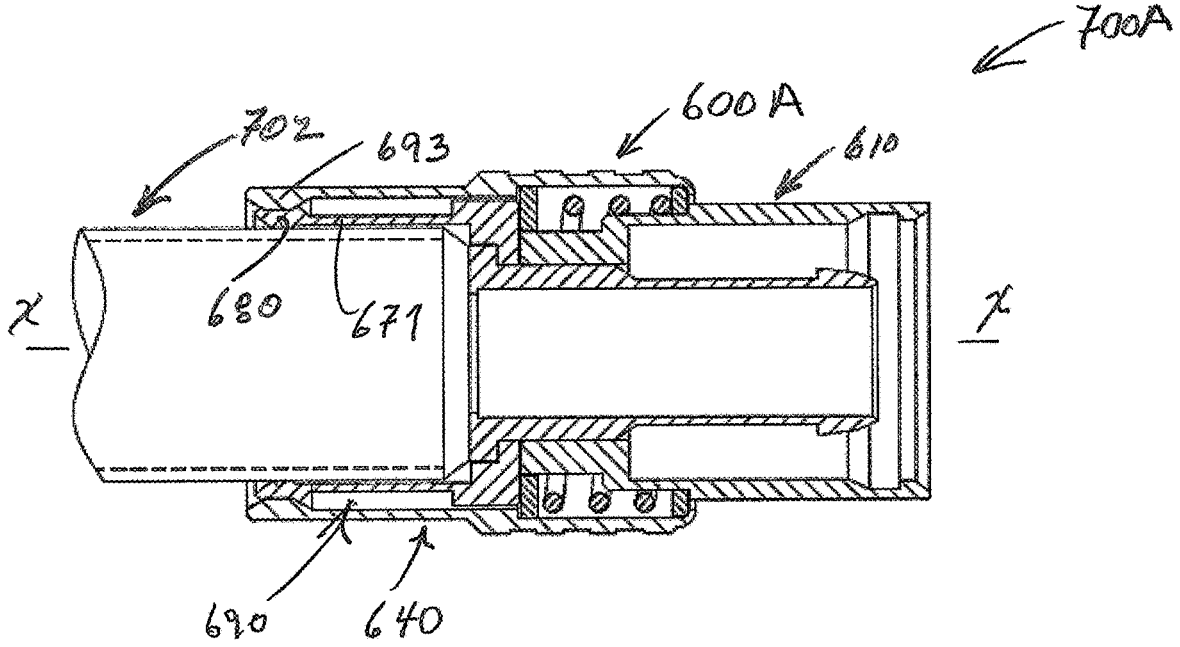
FIGS. 7A-D show cross-sectional views of a connector similar to the connectors of FIGS. 6A-C with a port inserted in the connector.
Figure 7B:
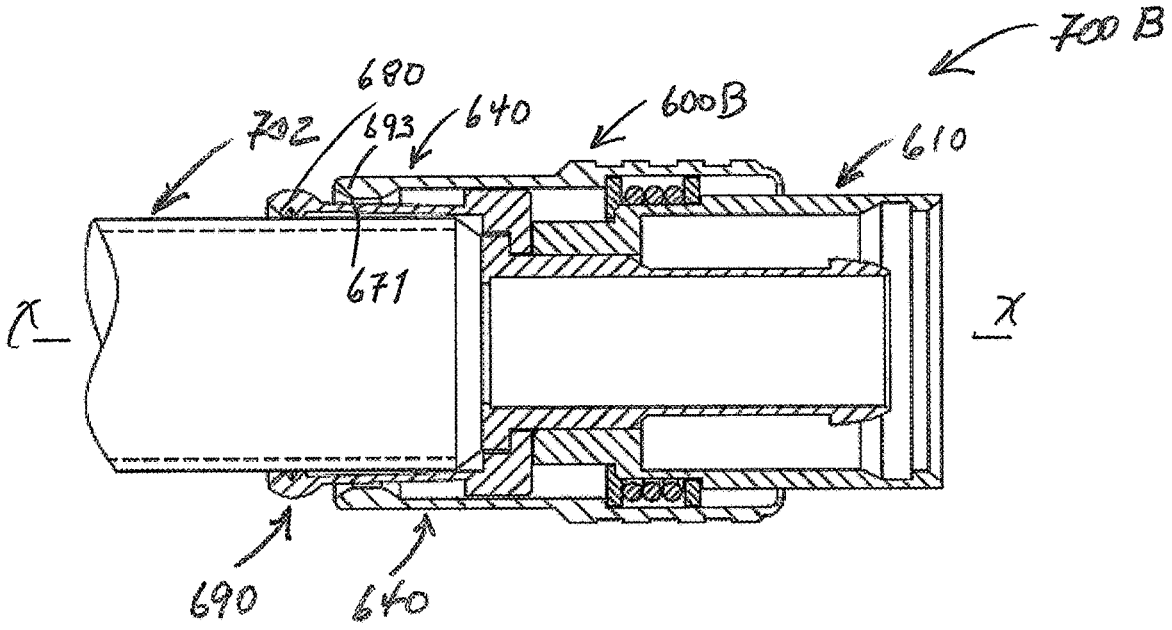
Figure 7C:
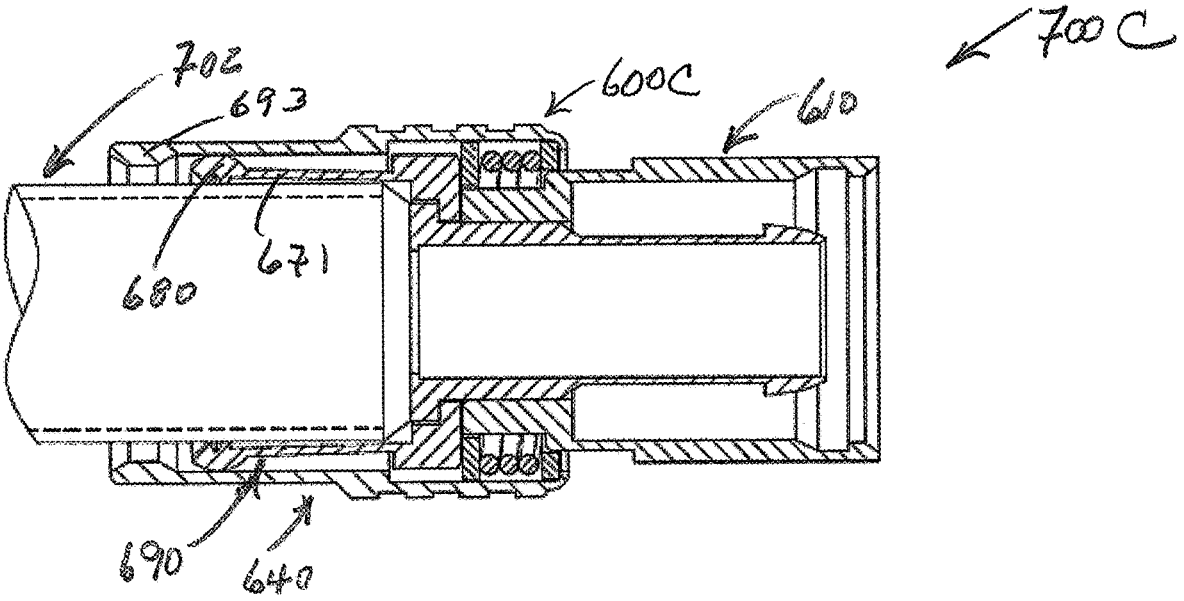
Figure 7D:
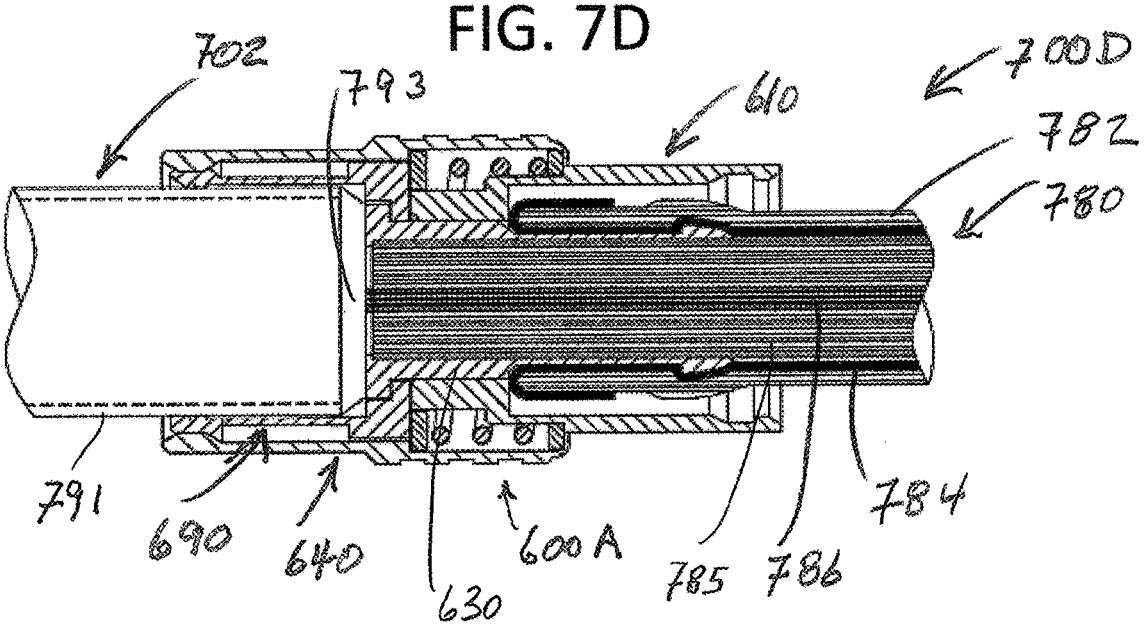

FIGS. 7A-C show the connector of FIGS. 6A-C with a port inserted in the connector 700A-C. FIG. 7D shows the connector of FIGS. 6A-C with a coaxial cable attached to the connector.

In FIG. 7A, the connector 600A is shown with a port 702 inserted. The connector outer shell 640 is shown in the rest position with the thickened end of the outer shell 693 encircling the thickened end of the finger basket 680. In this position the outer shell 640 is pressing the fingers 671 of the finger basket 690 toward the connector axis x-x and against the port 702.

In FIG. 7B, the connector 600B is shown with a port 702 inserted. The connector outer shell 640 is shown in a drawn back position with the finger basket 690 uncovered or partially uncovered. In this position the outer shell 640 does not press against the fingers 671 of the finger basket 690. In various embodiments, the fingers 671 may or may not be spread by insertion of the port in the finger basket.

In FIG. 7C, the connector 600C is shown with a port 702 inserted. The connector outer shell 640 is shown in a pushed forward position with the outer shell covering the finger basket and with the thickened end of the outer shell 693 advanced beyond the thickened end of the finger basket 680. In various embodiments the fingers 611 may or may not be spread by insertion of the port in the finger basket.

In FIG. 7D, the connector 600A is shown with a coaxial cable 782 inserted. A plug (not shown) may or may not be inserted in the connector body 610 in order to fix the cable in the connector. The coaxial cable includes an outer jacket 782, a center conductor 786, and a dielectric 785 between the center conductor and a grounding sheath 784 that is beneath the jacket. The center conductor is inserted in a port 702 center conductor receiver 793 and the ground is interconnected via one or more of the post, the body 610, the finger basket 690, and a conductive or metallic exterior 791 of the post 702.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments but should be defined only in accordance with the following claims and equivalents thereof.

What is claimed is:

1. A spring mouth F-Type connector comprising:

a tubular post having a stem extending from a flanged end, the stem having a thickened neck adjacent to a flange;

the post passes through an annular end of an unthreaded inner shell and through an annular end of a body, the body abutting the inner shell and the inner shell abutting the flange;

the body and the inner shell irrotatably coupled to a post neck;

the inner shell having an annular socket at one end, the socket for receiving the flange in a counterbored section of the socket such that an annular floor of the socket includes a flange face and a socket face that lie substantially in the same plane;

a spring coiled about the post neck, the spring having ends that push on an outer shell and on a body shoulder;

the outer shell moveable with respect to the inner shell such that in a first position finger tips of fingers of the inner shell are constrained by the outer shell and in a second position the finger tips are free to move away from a connector centerline;

movement of the outer shell to the second position compresses the spring while uncovering the inner shell such that a port is insertable in a finger basket of the inner shell;

movement of the outer shell to the first position expands the spring while covering the inner shell such that the port is fixed in the finger basket of the inner shell; and, port fixation accomplished by finger tip grooves that engage threads of the inserted port.

2. The connector of claim 1 wherein the outer shell movement is linear movement.

3. The connector of claim 1 wherein longitudinal slots in the inner shell separate the fingers and enable movement of the finger tips with respect to the connector center line.

4. The connector of claim 1 further comprising:

the finger tips having an arc-shaped cross section; and, the outer shell having a ramp-shaped cross section;

wherein advancement of the ramp over the arc constrains movement of the finger tips away from the connector centerline.

5. The connector of claim 1 wherein:

in a first state the spring fully expanded and the inner shell is not biased toward the connector centerline by the outer shell;

in a second state the spring is compressed and the outer shell finger basket is in the same position as it was in the first state;

in a third state the spring is compressed and the finger basket is opened when a port is inserted in the finger basket; and, in a fourth state the spring is expanded while the port is inserted in the finger basket, the finger tips engaging threads of the inserted port and the finger tips biased by the outer shell toward the connector center line.

6. The connector of claim 1 further comprising:

a spring pocket surrounding the post neck;

a body groove having a wall that provides a spring rest;

the outer shell internal shoulder that the spring pushes; and, an outer shell trailing stop for stopping outer shell movement when it strikes the body groove wall.

7. A F-Type connector engagement method comprising the steps of:

providing a tubular post with a stem extending from a flanged end, the stem having a thickened neck adjacent to a flange;

passing the post through an annular end of an unthreaded inner shell and through a body annular end, the body annular end abutting the inner shell annular end and the inner shell abutting the flange;

an inner shell annular end socket receiving in a counterbore the post flange such that an annular floor of the socket includes a flange face and a socket face that lie substantially in the same plane;

biasing the outer shell away from the body with a spring and irrotatably fixing the inner and outer shells to the post neck;

in a first movement retracting the outer shell and compressing a spring to uncover the finger tips;

in a second movement advancing the outer shell and expanding a spring to cover the finger tips;

after the first movement inserting a port in the connector; and, after the second movement the finger tips fixing the port in the connector.

8. The method of claim 7 wherein:

in a first state the spring fully expanded and the inner shell is not biased toward the connector centerline by the outer shell;

in a second state the spring is compressed and the outer shell finger basket is in the same position as it was in the first state;

in a third state the spring is compressed and the finger basket is opened when a port is inserted in the finger basket; and, in a fourth state the spring is expanded while the port is inserted in the finger basket, the finger tips engaging threads of the inserted port and the finger tips biased by the outer shell toward the connector center line.

9. The method of claim 8 further comprising the steps of:

surrounding the post neck with a spring pocket;

resting a spring end on a body groove wall;

biasing an outer shell internal shoulder with the spring; and, stopping outer shell movement when an outer shell trailing stop hits the body groove wall.

10. The method of claim 9 further comprising the steps of:

providing the finger tips with an arc-shaped cross section; and, providing the outer shell with a ramp-shaped cross section;

wherein advancement of the ramp over the arc constrains movement of the finger tips away from the connector centerline.

11. A spring mouth F-Type connector comprising:

an inner shell between first and second ends, the ends having a radial thickness greater than the radial thickness of a central portion adjoining the ends;

the first end for receiving a port and the second end for receiving a flange of a post;

the inner shell having longitudinal slots such that the inner shell first end forms a cylindrical basket of fingers;

each of the fingers terminating in a claw having an inwardly directed groove for mating with a port thread;

the inner shell second end having first and second internal diameters adjoining a third internal diameter of the central portion;

the first diameter less than the second diameter less than the third diameter;

the post flange fitted in the second diameter, bearing against the first diameter such that a post neck adjacent to the flange is irrotatably fitted into the first diameter, and extending to but not into the third diameter;

a post flange face and a wall adjoining the second and third diameters forming a planar floor within the second end of the inner shell, the planar floor for abutting the end of an inserted port; and, a spring coiled about the post neck that bears on a body shoulder and on the an outer shell such that the outer shell is movable with respect to the inner shell to cover or uncover the claws;

wherein a port may be inserted in the finger basket when the claws are uncovered and the port may be fixed in the finger basket when the claws are covered.

12. A spring mouth F-Type connector comprising:

an unthreaded inner shell including a finger basket and an outer shell;

a tubular post having a stem extending from a flanged end, the post passing through an annular end of the inner shell and through an annular end of a body, the body abutting the inner shell and the inner shell abutting a flange;

the body and the inner shell irrotatably coupled to the post neck;

an outer shell for selectively compressing fingers of the inner shell, the outer shell having an internal pocket with opposed shoulders;

between the opposed shoulders, a spring between first and second collars, the spring and the collars surrounding a connector axis;

an outer shell rest position where a thickened end of the outer shell encircles thickened ends of fingers of the finger basket;

an outer shell drawn back position where the thickened ends of the fingers of the finger basket are not covered by the outer shell; and, an outer shell pushed forward position where the outer shell covers the finger basket and the thickened end of the outer shell is advanced beyond the thickened ends of the fingers of the finger basket.

13. The spring mouth connector of claim 12 further comprising:

an inner shell annular socket for receiving the flange in a counterbored socket section such that an annular floor of the socket includes a flange face and a socket face that lie substantially in the same plane.

14. The spring mouth connector of claim 13 wherein when the outer shell is drawn back, the spring is compressed.

15. The spring mouth connector of claim 14 wherein when the outer shell is pushed forward, the spring is compressed.

16. The spring mouth connector of claim 15 wherein when the outer shell is in a rest position the spring is expanded.

17. The spring mouth connector of claim 16 wherein the spring encircles the connector body.

18. The spring mouth connector of claim 17 wherein the collars encircle the connector body.

* * * * *